US006095519A

United States Patent [19]

Shoemaker, Jr.

[11] Patent Number: 6,095,519

[45] Date of Patent: Aug. 1, 2000

[54] ARCADE GAME GAMEPIECE GUIDE WITH FLEXIBLE PORTION

[76] Inventor: Stephen P. Shoemaker, Jr., 140 The Village #401, Redondo Beach, Calif. 90277

[21] Appl. No.: 09/193,376

[22] Filed: Nov. 17, 1998

[51] Int. Cl.[7] ..... A63F 7/00

[52] U.S. Cl. ..... 273/119 R; 273/129 W; 273/126 R

[58] Field of Search ..... 273/108, 118 R, 273/118 A, 119 R, 119 A, 126 R, 126 A, 129 R, 129 Q, 129 V, 129 W, 440, 441, 454; 446/168; 124/1, 4, 42, 41.1, 80, 56

[56] References Cited

U.S. PATENT DOCUMENTS

| | | | |
|---|---|---|---|
| 682,965 | 9/1901 | Taylor | 124/1 |
| 3,529,589 | 9/1970 | Esser | 124/41.1 X |
| 3,999,753 | 12/1976 | Desilets et al. | 124/41.1 X |
| 4,303,248 | 12/1981 | Shoemaker, Jr. et al. . | |
| 5,071,127 | 12/1991 | Bromley et al. . | |
| 5,275,402 | 1/1994 | Malavazos et al. | 273/440 X |
| 5,421,313 | 6/1995 | Strayer | 124/1 |
| 5,445,376 | 8/1995 | Bromley | 273/108 X |
| 5,511,794 | 4/1996 | Katamoto | 273/126 A X |
| 5,667,217 | 9/1997 | Kelly et al. . | |
| 5,888,115 | 3/1999 | Shoemaker, Jr. et al. | 446/168 |

FOREIGN PATENT DOCUMENTS

| | | | |
|---|---|---|---|
| 2435268 | 5/1980 | France | 273/119 A |
| 1436276 | 5/1976 | United Kingdom | 273/119 R |

*Primary Examiner*—Raleigh W. Chiu
*Attorney, Agent, or Firm*—Hickman Stephens Coleman & Hughes, LLP

[57] ABSTRACT

An arcade game gamepiece directing mechanism facilitates a player in guiding a gamepiece in a desired direction over a playing surface. The gamepiece directing mechanism includes a rigid portion and a flexible portion connected to each other. The rigid portion receives inputs from the player and translates them to the flexible portion. When a gamepiece is received by the rigid portion and passed through the flexible portion, the combined motion of the rigid portion and flexible portion causes the gamepiece to travel in a particular direction over the playing surface. The rigid portion can be pivotally to the arcade game, while a distal end of the flexible portion can be restricted by an end restriction that restricts one, two, or three degrees of freedom of the distal end. The end restriction can also be movable relative to the playing surface.

28 Claims, 5 Drawing Sheets

ARCADE GAME GAMEPIECE GUIDE WITH FLEXIBLE PORTION

BACKGROUND OF THE INVENTION

1. Field of the Invention

The present invention generally relates to game machines that are typically played in an arcade, store, or other public environment, and more particularly to such games that are played by directing a playing piece across a playing surface.

2. Background of the Related Art

Game machines of many types are played in arcade environments. Roll-down games are popular types of arcade games that utilize a playing piece, such as a coin, ball, etc. that is directed down a playing surface, such as a ramp. A player can direct the playing piece at, onto or into targets or around obstacles, and a game score is accumulated based upon the player's success. In some games, a playing piece, or gamepiece, is directed by a pivoting chute, which is sometimes referred to as a shooter.

For example, U.S. Pat. No. 5,071,127, by Bromley et al., describes a coin bowling game in which a player directs the path of an inserted coin to roll on a playing field toward target pins. The coin is directed by a rigid pivotable coin chute. Also, U.S. Pat. No. 4,303,248, by Shoemaker, Jr. et al., describes a game in which players can each use a rigid pivotable coin chute to direct coins onto a surface having accumulated coins. A vertical dam translates over the surface to drop certain coins over the edge for a player score. Further, U.S. Pat. No. 5,667,217, by Kelly et al., describes a game in which a players directs coins across a playing surface with a rigid pivotable directing mechanism. The player uses the rigid pivotable directing mechanism to aim the coins at various targets in or on the playing surface.

These exemplary games of the prior art provide for player direction of a gamepiece by a rigid chute-type mechanism. With such a mechanism, the effect of a player's input on the direction of the gamepiece can be easily predicted by the player, and therefore less skill is necessary to achieve the game goals. More advanced players may desire a more challenging task than that provided with a rigid coin chute.

Therefore, a game is desired that requires more skill for a player to direct a gamepiece across a surface in a particular direction.

SUMMARY OF INVENTION

The present invention provides a gamepiece guide that requires more skill for a player to direct a gamepiece in a particular direction. This is accomplished by including a flexible guide portion in the gamepiece guide which can flex upon player inputs to the gamepiece guide, and can therefore introduce additional influences on the released direction and trajectory of the gamepiece during play.

An arcade game gamepiece directing mechanism that facilitates a player in guiding a gamepiece in a desired direction over a playing surface, in accordance with the present invention, includes a rigid chute portion and a flexible chute portion connected to each other. A player moves the rigid chute portion to cause a motion in the flexible portion. When a gamepiece is received by the rigid portion and passed through the flexible portion, any motion of the flexible portion causes the gamepiece to be released in a trajectory over the playing surface that is more difficult to predict. The rigid portion is preferably pivotally connected to the arcade game, while a distal end of the flexible portion can be restricted by an end restriction that restricts one, two, or three degrees of freedom of the distal end.

The present invention also provides a game apparatus that includes, for example, a playing surface with a player end and a target disposed on the playing surface. Also included is a gamepiece guide located at the player end of the playing surface, for directing at least one gamepiece across the playing surface in a desired direction related to the target. The gamepiece guide includes a flexible chute portion.

The relationship between the player input and the resulting gamepiece trajectory requires greater skill on the part of the player to attain certain game goals. This greater skill requirement leads to greater player enjoyment and overall greater time spent by the player with the game apparatus.

These and other advantages of the present invention will become apparent to those skilled in the art after reading the following descriptions and studying the various figures of the drawings.

DETAILED DESCRIPTION OF THE PREFERRED EMBODIMENTS

Figure 1:
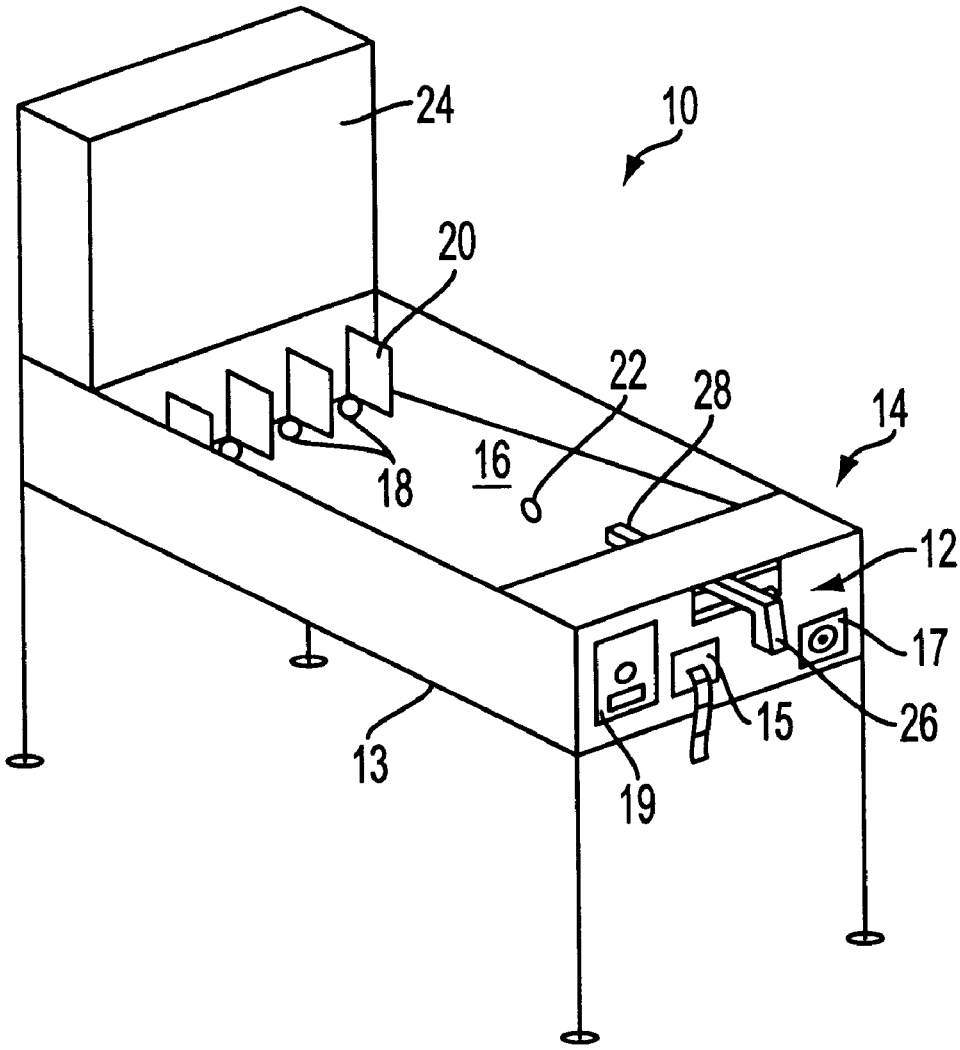
FIG. 1 is a perspective view of a game apparatus incorporating a gamepiece guide according to an embodiment of the present invention.

FIG. 1 is a perspective view of a game apparatus 10 incorporating a gamepiece guide mechanism 12 according to the present invention. The game apparatus 10 includes a housing 13 and a playing surface 16. It should be noted that the guide mechanism 12 of the present invention can be used with many types of game machines, of which game apparatus 10 is only one example.

The gamepiece guide mechanism 12 engages a player panel section 14 of the housing 13, which can be at the front of the game apparatus 10, as shown, or any other suitable position on the game apparatus 10. The player panel section 14 can include a ticket dispenser 15 and/or a speaker 17. An access door 19 can also be included, which can be opened by the operator to access a coin box and interior components of the game apparatus.

The playing surface 16 can be substantially flat and sloped as shown, or can have any other suitable shape, such as a concave curve or funnel. The playing surface 16 can alternatively have other orientations, such as substantially vertical. A gamepiece can be directed at, on and/or over the surface 16. Also, any combination of targets 18 and obstacles 20 can be included in or above the playing surface 16.

A gamepiece 22 (such as a coin, ball, or token representing a monetary value) is passed through the gamepiece guide mechanism 12 onto the playing surface 16 toward the targets 18 and obstacles 20. Game goals can be achieved by the interaction of the gamepiece 22 and targets 18 and obstacles 20. For example, if targets 18 include openings through the playing surface 16, a goal of the game can be accomplished by having the gamepiece 22 pass (e.g., roll) through one such opening. The game apparatus 10 can also include mechanical or electrical devices that respond to such goals being accomplished. For example, a score can be progressively increased with each attained goal, and then displayed on a display board 24.

Figure 2:
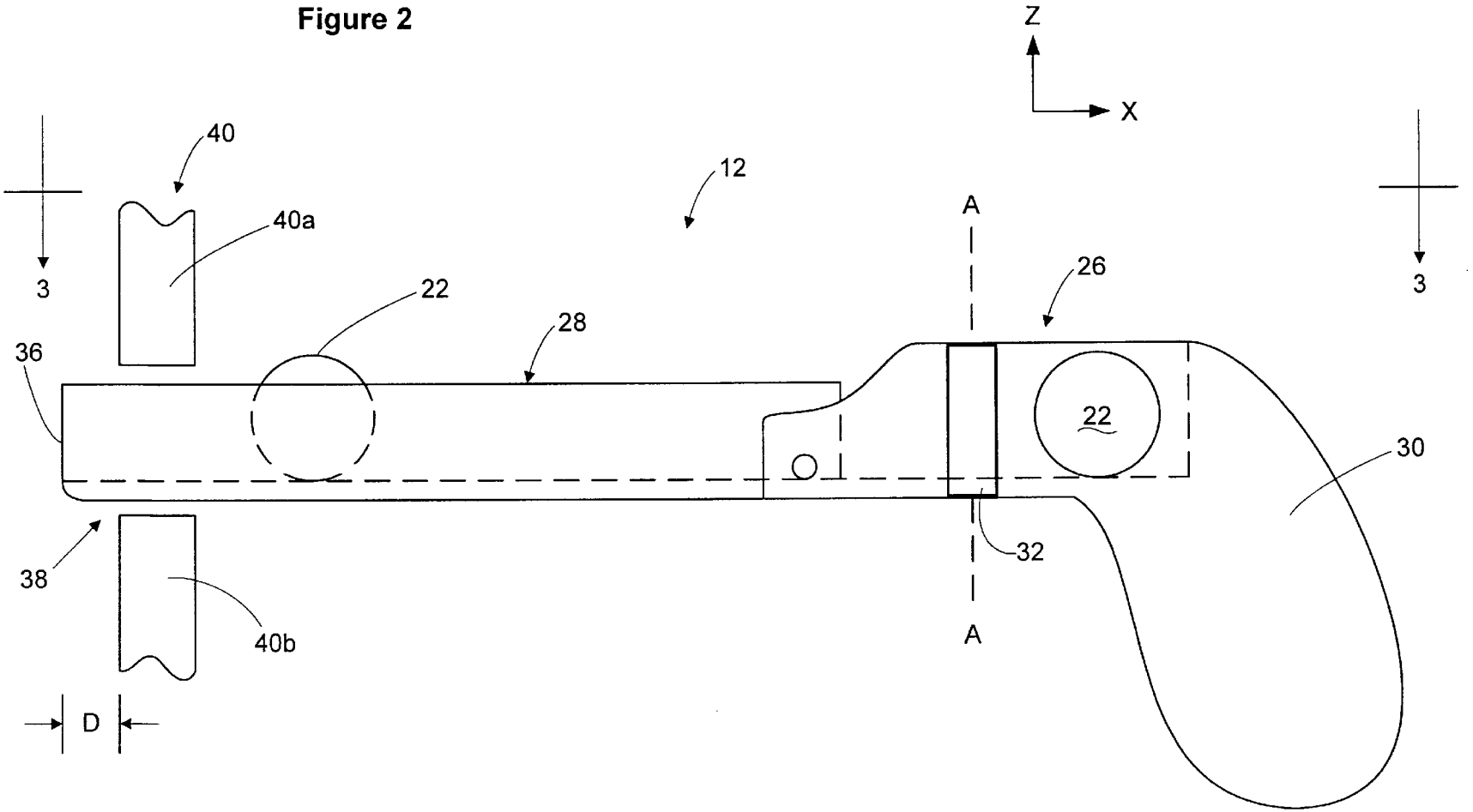
FIG. 2 is a side view of the gamepiece guide according to an embodiment of the present invention.

FIG. 2 is a side view of the gamepiece guide mechanism 12. The gamepiece guide mechanism 12 includes a rigid portion 26 connected to a flexible portion 28. The rigid portion 26 can be formed of any suitable rigid material such as metal or hard plastic. For example, aluminum can be used. The rigid portion can incorporate a player control 30, such as a rod, joystick, gun handle or similar object that includes a grip for the player to grasp or otherwise manipulate, or can be connected to a separate player control, such as a joystick. The player control 30 can be formed of an suitable material such as metal or plastic, for translating player physical inputs to the remainder of the gamepiece guide mechanism 12. The rigid portion 26 preferably engages the housing 13 while being free to rotate about an axis A. For example, this can be accomplished with a hinge 32 or equivalents thereof such as a pivot, stirrup, or other such connector.

The flexible portion 28 is preferably formed of a material and with a thickness that flexes without breaking, without undue pressure, while substantially returning to its original shape after such pressure is removed. For example, the flexible portion 28 can be formed of a flexible plastic material, such as nylon or low density polyethylene. Alternatively, elastic materials such as rubber type (i.e., natural or synthetic rubber) materials can be used for the flexible portion 28. For example, styrene-butadiene elastomers and other types of elastomers can be used. The rigid and flexible portions 26 and 28 can be connected together either fixedly, for example by a rivet, or pivotally, for example by a bolt or hinge. Of course, other suitable connectors can be used to either fixedly or pivotally join the portions. Although the rigid and flexible portions 26 and 28 are shown as two separate pieces connected together, alternatively the two portions can be integral to each other. For example, the two portions can be formed of the same continuous plastic or rubber type material, but with different thicknesses that result in different relative flexibilities between the rigid and flexible portions.

Whether the rigid and flexible portions 26 and 28 are integral to each other or separate connected portions, the rigid portion can be rigid in comparison with the flexible portion (i.e., have a flexibility that is less than a flexibility of the flexible portion), while still being relatively flexible as compared to other materials. Alternatively, the flexibility of the rigid portion 26 can be substantially comparable to the flexibility of the flexible portion.

Both the rigid portion 26 and flexible portion 28 have a groove, or chute 34 that can slidably or rollably receive a gamepiece that is configured to slide or roll on or over the playing surface 16, such as a coin, washer, token, ball, or wheeled object. The groove 34 is sized, shaped, and of a suitable material such that the gamepiece can easily advance along the length of the gamepiece guide mechanism 12 to about the guide end 36, for example through substantially only the operation of gravity. This can be accomplished, for example, with a groove 34 in plastic or rubber type material that is slightly wider than the gamepiece 22 and at least half as deep as the height of the gamepiece 22 while in the groove 34.

For exemplary purposes, dimensions of a gamepiece guide mechanism 12 that can be used with a coin gamepiece are next discussed. Such a gamepiece guide mechanism 12 can have, for example, a total length of about 24 inches, with a rigid portion of about 7 inches long, and a flexible portion of about 17 inches long. Also, the width and height of the rigid and flexible portions can be about ⅜ inches and two (2) inches, respectively, however the two portions can also have widths and/or heights that are different from each other. For example, the flexible portion can have a height of about ¾ inches while the rigid portion has a height of about two (2) inches. The groove 34 can have a height of about ½ inches and a width of about ⅛ inches. The groove dimensions may be different between the rigid and flexible portions, such as the above dimensions for the groove of the flexible portion, and a height of about 1⅛ inches in the rigid portion. Further, groove can incorporate an opening along a particular portion of its length, either in the rigid or flexible portion, through which gamepieces of an undesired size or shape can be expelled from the gamepiece guide mechanism. For example, if it is desired that only quarters be used in the gamepiece guide mechanism, dimes and other coins that are differently sized than quarters can be expelled through such an opening. For such an instance, the opening can be about ¾ inches high and about four (4) inches long. While the above dimensions are applicable to a substantially straight groove, rigid portion, and flexible portion, each of these can alternatively have a curvilinear or other shape. For example, a particular section of the groove in the rigid portion can have the shape of an S-curve in the x-y plane.

Figure 3:
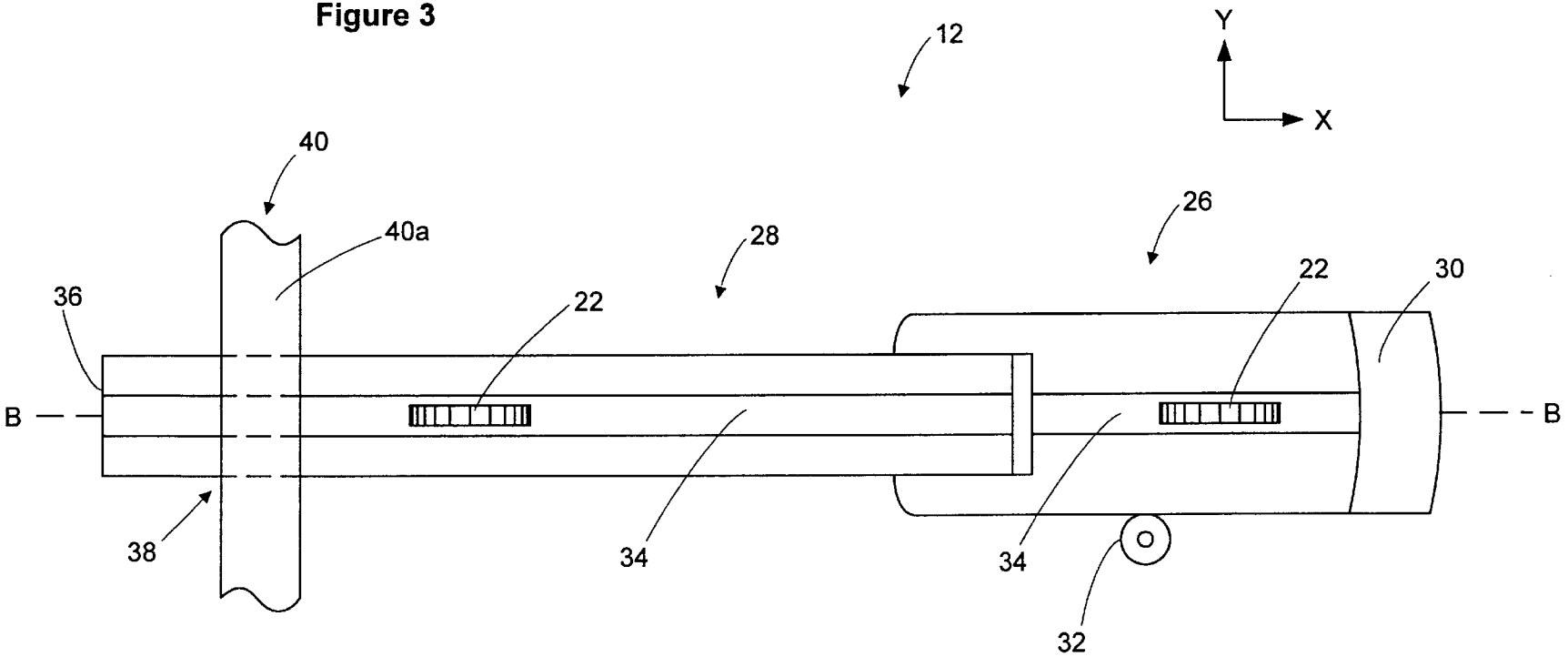
FIG. 3 is a top view of the gamepiece guide as seen along line 3—3 of FIG. 2.

The flexible portion 28 includes a distal end 38 that preferably engages an end restriction in the form of a track 40 as shown in FIGS. 2 and 3. The distal end 38 preferably engages the end restriction at a position along the flexible portion 28 that is a distance D from the guide end 36. As can be better understood with reference to FIG. 2, the track 40 includes a top track portion **40*a* above the distal end 38, and a bottom track portion 40*b* below the distal end 38, each of which can be attached to the housing 13. The flexible portion 28, and more particularly the distal end 38, slidably engages the track 40. Thus, with the pivoting of the rigid portion 26 about the axis A, the track 40 substantially limits the motion of the distal end 38 in the x-z plane (shown in FIG. 2), while allowing substantial motion in the x-y plane (shown in FIG. 3). The nature of the movement of the distal end 38 relative to the track 40 will be substantially affected by the coefficient of friction between the track 40 and the distal end 38, determined by their respective materials and any substances, such as lubricant, placed therebetween. Of course, as is known to one with ordinary skill in the art, other configurations of track 40 can be formed that would result in such motion of the distal end 38 relative to the track 40. For example, a single bottom track portion 40*a* can include a groove that is slidably engaged by a protrusion that extends from and is slidable along the bottom of the distal end 38. In other alternative configurations, the distal end can engage a track 40, with either one or both of the top and bottom track portions 40*a* and 40*b***, while still being free to move in the z-direction.

Figure 4:
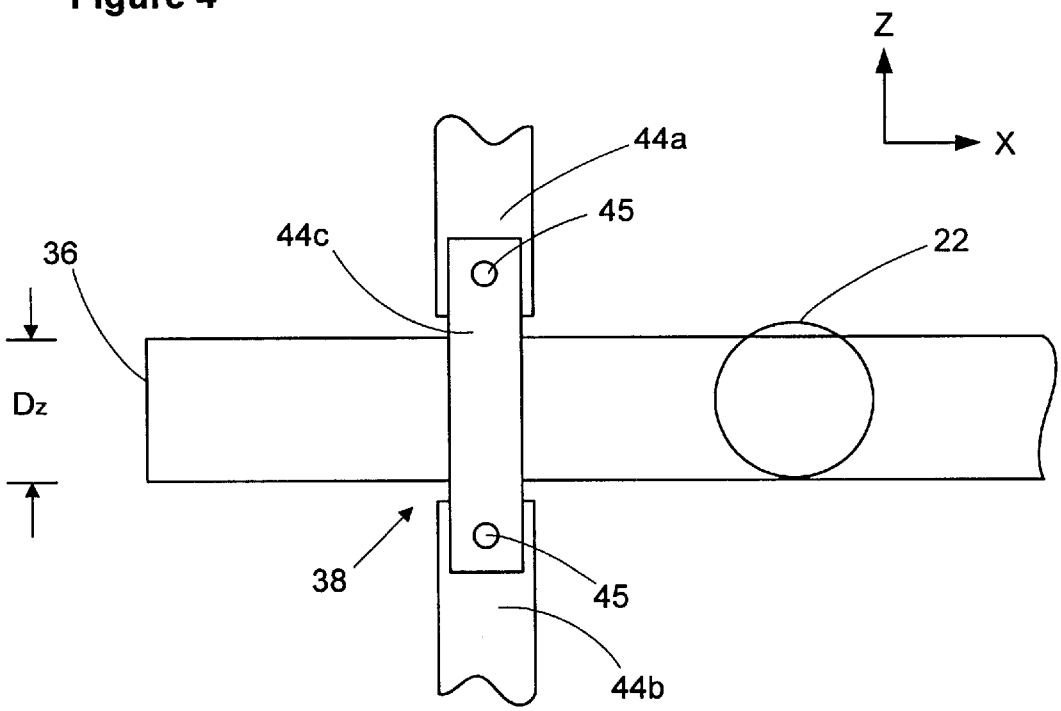
FIG. 4 is a side view of a distal end of a flexible portion of the gamepiece guide and an end restrictor according to another embodiment of the present invention.
Figure 5:
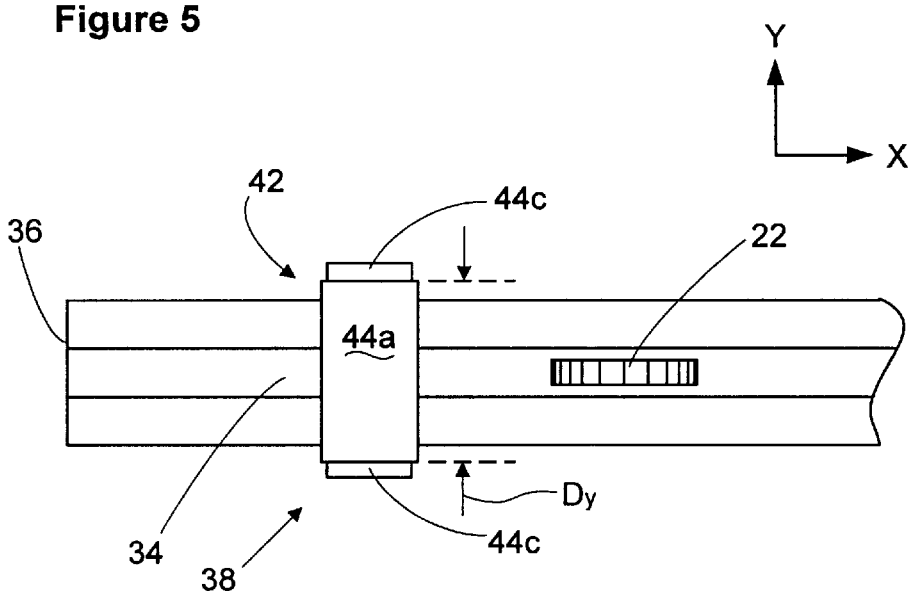
FIG. 5 is a top view of the distal end and end restrictor of FIG. 4, according to another embodiment of the present invention.

Alternatively, the distal end can engage an end restriction in the form of a bracket 42 as shown from the side and top in FIGS. 4 and 5, respectively. A top bracket portion **44*a* and a bottom bracket portion 44***b* bound the distal end 38 from above and below, respectively. Thus, the distal end motion is substantially limited in the z-direction. The top and bottom bracket portions 44*a* and 44*b* can be separated by a desired distance Dz that defines the range of motion, in the z-direction, of the distal end. Also, two side bracket portions 44*c* can bound the distal end 38 on either side, substantially limiting motion of the distal end 38 in the y-direction. Further, the side bracket portions 44*c* can be separated by a desired distance Dy that defines the range of motion, in the y-direction, of the distal end. While the bracket portions are shown as being discrete and connected with fasteners such as rivets 45, the bracket 42 can include one or more integral portions. Also, other configurations of end restrictions can interact with the guide mechanism 12 to similarly restrict motion of the distal end in the y- and z-directions.

In an embodiment of the present invention, a position of the bracket 42 can be fixed relative to the housing 13, playing surface 16 or other element of the game apparatus 10 other than the guide mechanism 12. In another embodiment, the position of the bracket 42 can be variable with relation to (i.e., free to move in one or more directions relative to) the housing, playing surface 16, or other element of the game apparatus 10. For example, the bracket 42 can be moved along the length of the flexible portion 28. In addition, or alternatively, the bracket 42 can move in a substantially straight line, for example in the y- or z-direction, or in a curved line, for example in the x-y plane. In conjunction with such motion, the bracket 42 can be either rigidly or slidably connected to the flexible portion.

Movement of the bracket 42 can be influenced by inputs from one or both of the user and a controller (not shown). The controller can be mechanical, electrical, or any combination of the two, and can influence the movement of the bracket 42 automatically, in conjunction with user inputs, continuously, and/or randomly. Further, the controller can influence the movement of the bracket 42 in conjunction with a motor that is connected to the bracket 42, for example. In still yet another embodiment, the bracket 42 can be used in conjunction with the track 40. Of course, in other alternative embodiments, the end restriction can be omitted, such that the flexible portion 28 can move freely within its intrinsic limits of flexure.

The gamepiece 22 can be introduced to gamepiece guide mechanism 12 through any suitable mechanism such as by the player placing the gamepiece 22 directly onto the groove 34 of the gamepiece guide mechanism 12 or by the player placing the gamepiece 22 into a gamepiece feeder (not shown) which deposits the gamepiece 22 into the groove 34. With either of these two methods, the gamepiece can also be the monetary unit used to initiate the game. As an alternative, the gamepiece 22 can be fed from within the game apparatus into the groove 34 upon game initiation. In such a latter game apparatus, the game apparatus can include a coin deposit slot (not shown), with the game being initiated by inserting a coin, token, or other monetary input into the game apparatus via, for example, the coin deposit slot. Such a game apparatus can also include mechanisms by which the monetary input can be recognized, stored, and returned, as is well known in the art. As a further alternative, while in some embodiments the introduction of the gamepiece into the groove 34 is limited to some portion of the groove proximate the player, in other embodiments the gamepiece can be introduced at other locations along the length of either the rigid portion 26 or the flexible portion 28.

During play, the gamepiece 22 passes through the gamepiece guide mechanism 12 and onto the playing surface, for example a coin or token rolls on its edge down the groove 34 and onto the playing surface 16. Upon exiting the gamepiece guide mechanism 12, the gamepiece 22 moves along the playing surface 16 with a trajectory that is at least partially determined by the orientation of a central axis B of the distal end 38 of the flexible portion 28. It is by influencing this trajectory, through inputs to the gamepiece guide mechanism 12, that a player can cause the gamepiece 22 to interact with the targets and obstacles as desired. Examples of such inputs and resulting axis B orientation can be better seen with reference to FIGS. 6 and 7.

Figure 6:
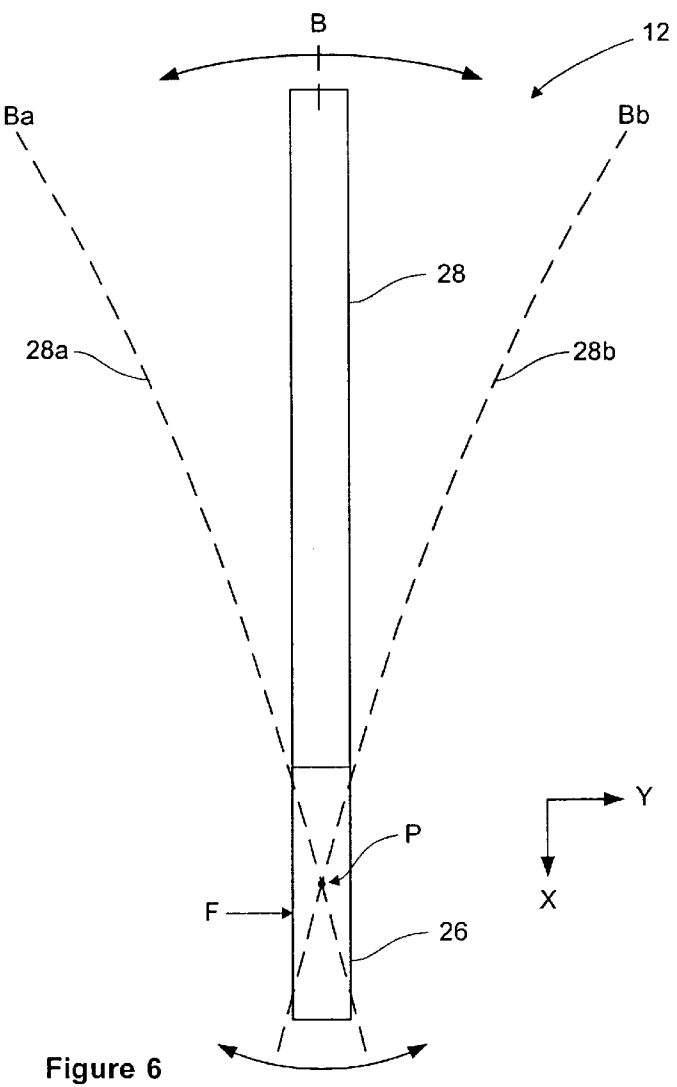
FIG. 6 is a top view of various positions of the gamepiece guide, with movement of the distal end unrestricted, according to an embodiment of the present invention.

FIG. 6 shows a top view of the gamepiece guide mechanism 12 that can engage an end restriction in the form of a track 40 (shown in FIGS. 2 and 3) or which can be unrestricted by an end restriction. The position and shape, in the x-y plane, of the flexible portion 28 is shown without player input and after two different exemplary player "inputs," i.e., forces exerted by the player on the rigid portion 26. When the gamepiece guide mechanism 12 is pivoted counterclockwise around or near pivot point P (such as provided by hinge 32) by a user exerting a force F, in a first direction, on the rigid portion 26, the position and shape of the flexible portion 28 can change to that shown by dashed line 28*a*. Similarly, when the gamepiece guide mechanism 12 is pivoted clockwise about the pivot point P, the dashed line 28*b* shows a resulting position and shape of the flexible portion. That is, the flexible portion 28 flexes or bends.

This flexure and its degree can be influenced by various factors. For example, if a player accelerates the rigid portion with the force F, the distal end will move at a rate that is less than that of the remainder of the flexible portion, thus resulting in a bend in the flexible portion. This bending can be influenced by the acceleration of the rigid portion, the location along the gamepiece guide where the force F is imparted, the location of the pivot point P, and the flexibility of the flexible portion. Therefore, when the user stops exerting a force F in the x-y plane on the rigid portion 26 (i.e., the rigid portion negatively accelerates), the distal end may continue to move in the x-y plane after substantially the remainder of the flexible portion has stopped movement. It should also be understood that the flexible portion can also be caused to bend in planes other than the x-y plane with the imparting of a force in a plane other than the x-y plane. Of course, the rate of movement of the distal end can be further decreased through friction, for example by forcing the distal end to contact a surface, such as the track 40, during its movement.

As can be appreciated from the dashed lines, the flexible portion 28 curves in the x-y plane with appropriate input from a player in the x-y plane. As shown by the axes Ba and Bb, respectively, the counterclockwise and clockwise pivoting result in different orientations of the distal end center axis. In turn, these different orientations result in different trajectories and speeds of a gamepiece 22 exiting the distal end 38. While FIG. 6 depicts representative curvatures, other curvatures, and therefore other trajectories and speeds, may result depending upon, among other parameters, the dimensions and material properties of the gamepiece guide mechanism, as well as the rate at which the force F imparted by the player to the flexible guide is applied. The variability of the trajectory and speed and their relation to the user inputs provide additional difficulty to the player in playing the game.

Figure 7:
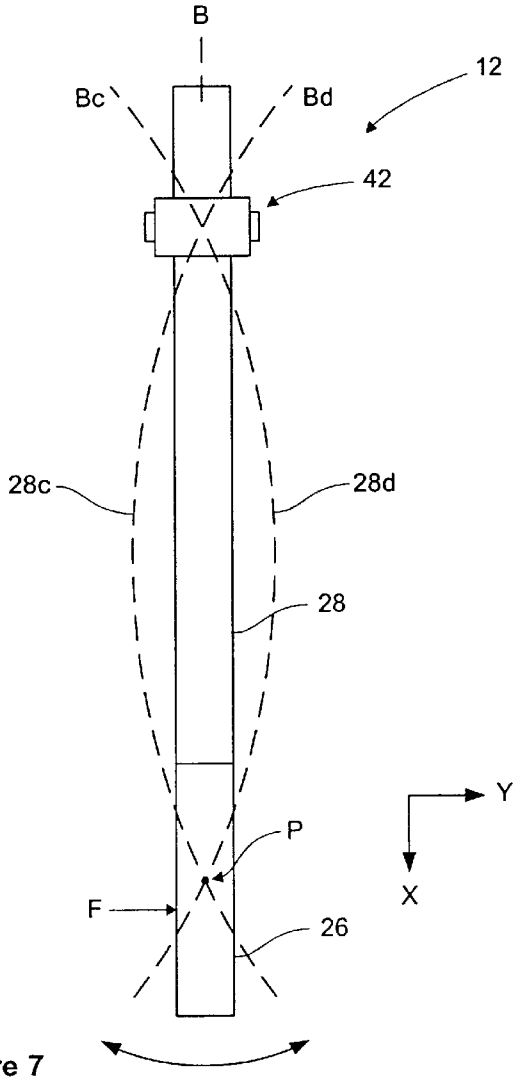
FIG. 7 is a top view of various positions of a gamepiece guide, with movement of the distal end restricted in two directions, according to an embodiment of the present invention.

FIG. 7 is a top view of the gamepiece guide mechanism 12 that engages an end restriction in the form of a bracket 42 (shown in FIGS. 4 and 5). Again, the position and shape, in the x-y plane, of the flexible portion 28 is shown without player input and after two different exemplary player inputs. When the gamepiece guide mechanism 12 is pivoted counterclockwise about pivot point P, the position and shape of the flexible portion 28 can change to that shown by dashed line 28*c*. Similarly, when the gamepiece guide mechanism 12 is pivoted clockwise about the pivot point P, the dashed line 28*d* shows a resulting position and shape of the flexible portion. As can be appreciated from the dashed lines, the flexible portion 28 curves in the x-y plane with appropriate input from a player.

As is seen by comparison with FIG. 6, the curvature of the flexible portion 28 of this embodiment, and resulting distal end axis orientations Bc and Bd, respectively, are different than that experienced with the embodiment of FIG. 6. That is, in this embodiment a clockwise pivot of the rigid portion 26 can result in a counterclockwise movement of the distal end of the flexible portion 28, and vice versa. It should be noted that, in the embodiment of FIG. 7, the flexing or bending of the flexible portion 28 is influenced differently by the force F exerted by the player than the embodiment of FIG. 6 is influenced. In particular, the flexible portion 28 can bend merely by the application of the force F without acceleration of the rigid portion. Of course, other restrictions, such as different types or at different locations along the length of the flexible portion, can result in different bending and therefore different trajectories of a gamepiece 22. The variability of the trajectory and its relation to the user inputs provides additional difficulty to the player in playing the game.

Of course, similar flexure of the flexible portion 28 can be accomplished in embodiments of the present invention including a bracket 42 that is free to move relative to the housing 13, playing surface 16, gamepiece guide mechanism 12, and/or other elements of the game apparatus 10. In such embodiments, the flexure of the flexible portion could be influenced by both the position of the bracket 42 and the user inputs to the rigid portion 26. Such flexure could have a complex form, which can be difficult to predict, and can provide additional difficulty in playing of the game.

While the present invention has been shown with a rigid portion pivotally fixed to the housing 13, the flexible portion can be so fixed, while a distal portion of the rigid portion engages an end restriction. Also, although the invention has been described as receiving the gamepiece first at the rigid portion, and then passing the gamepiece to the flexible portion, alternatively the gamepiece can be first received by the flexible portion, then passed to the rigid portion, and then on or above the playing surface. As a further alternative, the gamepiece guide can include other rigid or flexible portions in combination with the above described rigid portion and flexible portion. For example, the gamepiece guide can include the rigid portion connected to a first end of the flexible portion as described above, with another rigid portion connected to a second end of the flexible portion. Also, multiple portions with varying flexibilities can be connected in a similar fashion. Of course, a single flexible portion can form the entire gamepiece guide mechanism as well. In such an embodiment, the pivot point P could be located at a point along the single flexible portion, with a player imparting the force F at another point along the single flexible portion to cause bending of the single flexible portion.

The gamepiece guide mechanism of the present invention can be used in conjunction with any suitable game that includes the placement of a gamepiece relative to a playing field. While this may include games such as the roll-down game of FIG. 1, the present invention can also be used in other games with different directions of play, gamepieces, and modes of gamepiece movement, to name a few.

While this invention has been described in terms of several preferred embodiments, it is contemplated that alterations, modifications and permutations thereof will become apparent to those skilled in the art upon a reading of the specification and study of the drawings It is therefore intended that the following claims include all such alterations, modifications and permutations as fall within the spirit and scope of the present invention.

What is claimed is:

1. A game apparatus, comprising:

a playing surface having a player end;

a target disposed on said playing surface; and a gamepiece guide pivotally attached at said player end of said playing surface, for directing at least one gamepiece across said playing surface in a desired direction related to said target, said gamepiece guide including a rigid portion connected to a flexible portion.

2. The game apparatus as recited in claim 1, further comprising a game housing connected to said playing surface, said gamepiece guide being pivotally fixed to said game housing.

3. The game apparatus as recited in claim 2, wherein said flexible portion has a proximate end connected to said rigid portion, and a distal end, said game apparatus further comprising an end restriction which said distal end of said flexible portion engages.

4. The game apparatus as recited in claim 3, wherein said end restriction is a track disposed above and below said distal end of said flexible portion, and said distal end of said flexible portion slidably engages said track.

5. The game apparatus as recited in claim 3, wherein said end restriction substantially surrounds a circumference of said distal end of said flexible portion.

6. The game apparatus as recited in claim 5, wherein said end restriction is movable relative to said playing surface.

7. The game apparatus as recited in claim 5, wherein said end restriction is movable by a motor that is configured to receive inputs from a controller.

8. A game apparatus comprising:

an enclosure;

a playing surface disposed within said enclosure; and an elongated gamepiece guide, including a groove receptive to a gamepiece, said guide being pivotally attached to said enclosure at a pivot region of said guide that is proximate a first end of said guide, and said guide including at least a portion, located between said pivot region and a second end of said guide, which is capable of flexure in response to a force exerted on said guide near said first end by a player of said game apparatus;

whereby said force exerted by said player can cause said at least a portion of said guide to flex.

9. The game apparatus as recited in claim 8, further comprising an end restriction engaged by a restricted portion of said gamepiece guide, for restricting a movement of said gamepiece guide.

10. The game apparatus as recited in claim 9, wherein said end restriction is a track which bounds said restricted portion of said flexible portion from above and below, and which said restricted portion of said gamepiece guide slidably engages.

11. The game apparatus as recited in claim 9, wherein said end restriction substantially surrounds a circumference of said restricted portion of said gamepiece guide.

12. The game apparatus as recited in claim 8, wherein said gamepiece guide includes a rigid portion and a flexible portion, said flexible portion including said at least a portion of said guide.

13. A game apparatus comprising:

an enclosure;

a playing surface disposed within said enclosure; and an elongated gamepiece guide, including a groove receptive to a gamepiece, said guide being pivotally attached to said enclosure at a pivot region of said guide that is proximate a first end of said guide, and said guide including at least a portion, located between said pivot region and a second end of said guide, which is capable of flexure in response to a force exerted on said guide near said first end by a player of said game apparatus;

whereby said force exerted by said player can cause said at least a portion of said guide to flex, and wherein said at least a portion of said guide is formed of a material selected from the group consisting of plastic and rubber type material.

14. A gamepiece guide for directing a gamepiece of a game, comprising:

a rigid portion provided with a first groove portion configured to receive a gamepiece proximate a first end and pass said gamepiece from a second end;

a flexible portion connected to said rigid portion and provided with a second groove portion having a first end and a second end, wherein said first end of said second groove portion is aligned with said second end of said first groove portion and configured to receive said gamepiece and said second groove portion is configured to pass said gamepiece at said second end.

15. The gamepiece guide as recited in claim 14, wherein said rigid portion is configured to pass said gamepiece to said flexible portion, and said flexible portion is configured to receive said gamepiece from said rigid portion.

16. The gamepiece guide as recited in claim 14, wherein said flexible portion is configured to pass said gamepiece to said rigid portion, and said rigid portion is configured to receive said gamepiece from said flexible portion.

17. The gamepiece guide as recited in claim 1, wherein said rigid portion is to be pivotally affixed to a game housing.

18. The gamepiece guide as recited in claim 14, wherein said flexible portion is comprised of a material selected from the group consisting of plastic and rubber type material.

19. The gamepiece guide as recited in claim 18, wherein said flexible portion is integral with said rigid portion.

20. A gamepiece guide for directing a gamepiece of a game, comprising:

a rigid portion to be pivotally affixed to a game housing and configured to receive and pass a gamepiece;

a flexible portion connected to said rigid portion and configured to receive and pass said gamepiece; and an end restriction for restricting a movement of said flexible portion.

21. The gamepiece guide as recited in claim 20, wherein said end restriction is a track which bounds said distal end of said flexible portion from above and below, and which said distal end of said flexible portion slidably engages.

22. The gamepiece guide as recited in claim 20, wherein said end restriction substantially surrounds said circumference of said distal end of said flexible portion.

23. The gamepiece guide as recited in claim 22, wherein said end restriction is free to move along the length of said flexible portion.

24. A gamepiece directional mechanism for initiating a direction of movement of a gamepiece over a playing surface, comprising:

input means for accepting a directional input from a player;

directing means for guiding said gamepiece in a curvilinear path, having a proximate end and a distal end, and connected to said input means at said proximate end such that said directional input affects said curvilinear path.

25. A gamepiece directional mechanism for initiating a direction of movement of a gamepiece over a playing surface, comprising:

input means for accepting a directional input from a player;

directing means for guiding said gamepiece in a curvilinear path, having a proximate end and a distal end, and connected to said input means at said proximate end such that said directional input affects said curvilinear path; and fixing means for pivotally fixing said input means to a game housing.

26. The gamepiece directional mechanism as recited in claim 25, further comprising restriction means for at least partially limiting the motion of said distal end of said directing means.

27. The gamepiece directional mechanism as recited in claim 26, wherein said restriction means substantially restricts one degree of freedom of said distal end of said directing means.

28. The gamepiece directional mechanism as recited in claim 26, wherein said restriction means substantially restricts two degrees of freedom of said distal end of said directing means.

* * * * *